US008448443B2

(12) United States Patent
Berry et al.

(10) Patent No.: US 8,448,443 B2
(45) Date of Patent: May 28, 2013

(54) COMBUSTION LINER THIMBLE INSERT AND RELATED METHOD

(75) Inventors: Jonathan D. Berry, Simpsonville, SC (US); Russell P. DeForest, Simpsonville, SC (US); Abhijit Som, Greer, SC (US)

(73) Assignee: General Electric Company, Schenectady, NY (US)

( * ) Notice: Subject to any disclaimer, the term of this patent is extended or adjusted under 35 U.S.C. 154(b) by 419 days.

(21) Appl. No.: 11/907,332

(22) Filed: Oct. 11, 2007

(65) Prior Publication Data

US 2009/0120095 A1 May 14, 2009

(51) Int. Cl.
*F23R 3/06* (2006.01)

(52) U.S. Cl.
USPC ..... 60/754; 60/759

(58) Field of Classification Search
CPC ..... F23R 3/06
USPC ..... 60/757, 754, 755, 756, 759, 760, 60/752; 431/352
See application file for complete search history.

(56) References Cited

U.S. PATENT DOCUMENTS

| | | | | |
|---|---|---|---|---|
| 3,758,222 | A * | 9/1973 | Oakes | 408/224 |
| 4,622,821 | A | 11/1986 | Madden | |
| 4,653,279 | A | 3/1987 | Reynolds | |
| 4,700,544 | A | 10/1987 | Fucci | |
| 4,749,298 | A * | 6/1988 | Bundt et al. | 403/23 |
| 4,875,339 | A | 10/1989 | Rasmussen et al. | |
| 5,402,635 | A * | 4/1995 | Smith et al. | 60/39.37 |
| 5,575,154 | A | 11/1996 | Loprinzo | |
| 6,000,908 | A | 12/1999 | Bunker | |
| 6,205,789 | B1 * | 3/2001 | Patterson et al. | 60/754 |
| 6,331,110 | B1 | 12/2001 | Steber et al. | |
| 6,484,505 | B1 | 11/2002 | Brown et al. | |
| 7,007,481 | B2 * | 3/2006 | McMasters | 60/752 |
| 2006/0029500 | A1 * | 2/2006 | Cherolis et al. | 416/193 A |

* cited by examiner

*Primary Examiner* — Andrew Nguyen
(74) *Attorney, Agent, or Firm* — Nixon & Vanderhye, P.C.

(57) ABSTRACT

A gas turbine combustor liner has at least one circumferential row of air holes adapted to supply air in a radial direction into a combustion chamber within the liner. One or more of the air holes have a thimble fixed therein, the thimble having a substantially circular body and a pair of lips extending from an interior end of the thimble in diametrically opposed upstream and downstream directions.

15 Claims, 4 Drawing Sheets

COMBUSTION LINER THIMBLE INSERT AND RELATED METHOD

BACKGROUND OF THE INVENTION

This invention relates generally to gas turbine combustion technology and, more specifically, to an impingement cooled metal shield located around the inside edge of a combustor component, for example, a combustion liner at the forward and aft edges of the air mixing holes formed in the liner.

In a gas turbine combustion system, the combustion chamber casing contains a liner which is typically of a tubular or annular configuration with a closed end and an opposite open end. Fuel is ordinarily introduced into the liner via one or more fuel nozzles at or near the closed end, while combustion air is admitted through circular rows of apertures or air mixing holes spaced axially along the liner. These gas turbine combustion liners usually operate at extremely high temperatures and depend to a large extent on incoming combustion air from an appropriate compressor for cooling purposes.

Cracking around combustion liner air mixing holes is a common life-limiting failure mode for gas turbine combustor liners. In this regard, certain gas turbine engines use highly reactive fuel as the primary fuel source. Highly reactive fuel tends to pull the flame forward in the liner and anchor the flame both before (upstream of) and after (downstream) mixing row holes, typically most pronounced on the first mixing hole row (i.e., at the end of the liner closest to the fuel nozzles). Additionally, low BTU fuels and subsequent higher volume fuel flow amplify these flame anchoring effects. Other typically used fuels, on the other hand, cause the flame to anchor after or downstream of the mixing holes. Nevertheless, tests have confirmed very high temperatures on both sides of the air mixing holes.

While the problem of cracking has been addressed for locations downstream of the air mixing holes where the flame normally anchors, cracking problems along the upstream edge of the air mixing holes have not been addressed.

Thus, current solutions involve reestablishing cooling film flow only along the downstream edge of the air mixing hole, the flow having been interrupted by the radial flow of air through the air mixing hole. Air mixing hole inserts, sometimes referred to as refilmers, have been used to reestablish a cooling flow film along the interior surface of the combustor liner downstream of the air mixing hole as exemplified, for example, in U.S. Pat. No. 4,622,821. Other refilmer devices are disclosed in U.S. Pat. Nos. 4,875,339; 4,653,279; and 4,700,544.

BRIEF DESCRIPTION OF THE INVENTION

The invention disclosed herein provides an air mixing hole insert that cools both the upstream and downstream edges of the air mixing hole. Accordingly, in one aspect, the present invention relates to a gas turbine hot gas path component having at least one circumferential row of air mixing holes adapted to supply air in a radial direction, one or more of the air mixing holes having a thimble fixed therein, the thimble having a substantially circular body defining a center opening and a shield extending from an interior end of the thimble at least in diametrically opposed upstream and downstream directions within the component.

In another aspect, the invention relates to a gas turbine combustor component having at least one circumferential row of air holes adapted to supply air in a radial direction into a combustion chamber within the combustor component, one or more of the holes having a thimble fixed therein, the thimble having a substantially cylindrical body having a radiused exterior inlet end and a pair of lips extending from an interior end of the thimble in diametrically opposed upstream and downstream directions; wherein each lip is radially spaced from an inner surface of the component; and wherein the component is provided with at least one opening overlying each of the lips.

In still another aspect, the invention relates to A method of cooling upstream and downstream edges of plural combustion air supply holes in a turbine combustor component comprising: a) enlarging a diameter of the plural combustion air supply holes; and b) inserting thimbles in the plural combustion supply holes, each thimble having a substantially cylindrical body defining a center opening and a shield extending from an interior end of the thimble in at least diametrically opposed upstream and downstream directions within the component.

DETAILED DESCRIPTION OF THE INVENTION

Figure 1:
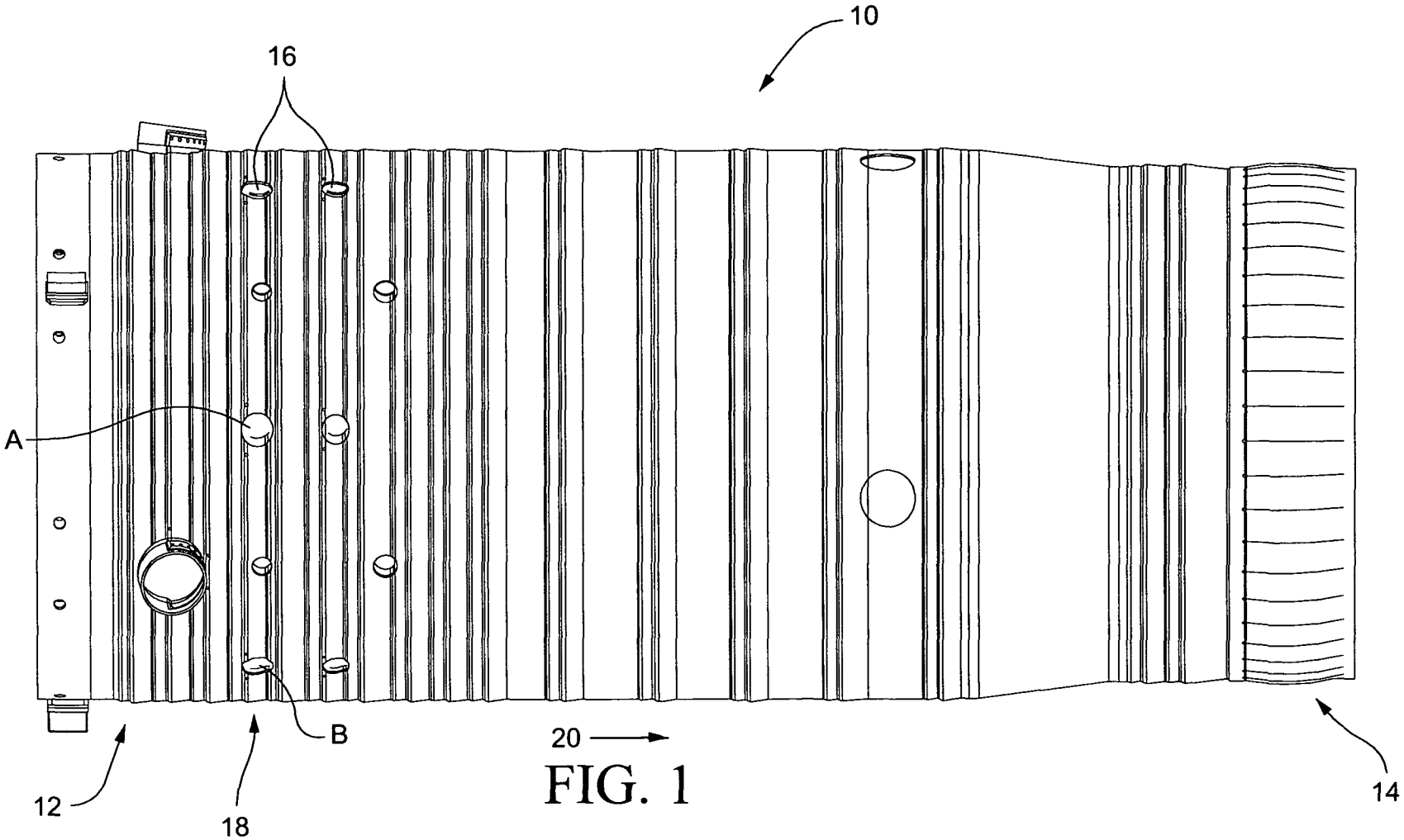
FIG. 1 is a side elevation view of a conventional gas turbine combustor liner.

With reference now to FIG. 1, a conventional turbine combustor liner 10 includes a generally cylindrical, segmented body having a forward end 12 and an aft end 14. The forward end 12 is typically closed by liner cap hardware that also mounts one or more fuel injection nozzles for supplying fuel to the combustion chamber within the liner. The opposite end of the liner is typically secured to a tubular transition piece that supplies the hot combustion gases to the first stage of the turbine. The invention is not limited, however, to liners as illustrated in FIG. 1, or to use in a combustor liner. The invention described below is applicable to any hot gas path combustor component where cooling air is required.

A plurality of axially-spaced, circumferential rows of air dilution or air mixing holes 16 are formed in the combustor liner toward the forward end 12 of the liner, i.e., closer to the fuel nozzles. A first of the rows of air dilution or air mixing holes is shown at 18 and is discussed further hereinbelow. The flow of combustion gases (inside the liner) is in a direction indicated by the flow arrow 20, it being understood that the combustion/dilution air is supplied radially into the liner.

Figure 2:
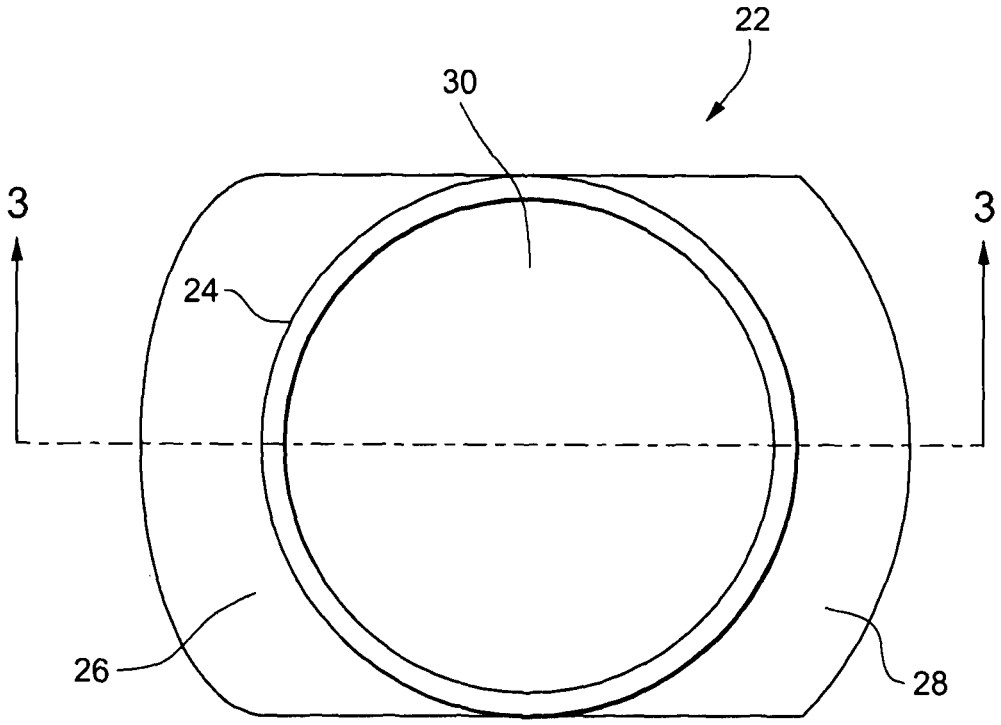
FIG. 2 is a top plan view of a thimble insert in accordance with an exemplary but non-limiting embodiment.
Figure 3:
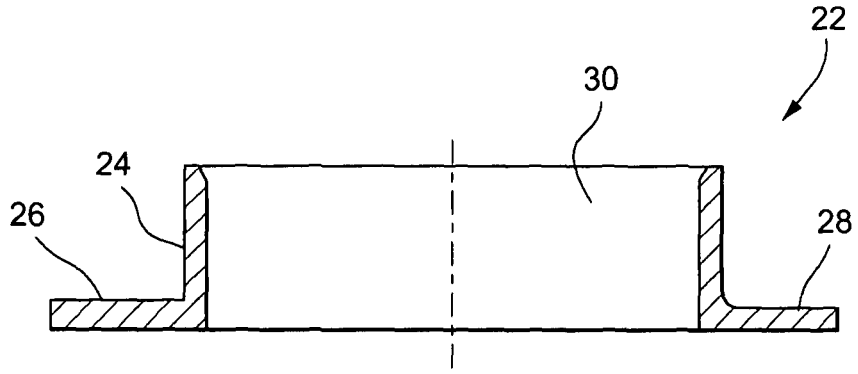
FIG. 3 is a section view taken along the line 3-3 of FIG. 2.

With reference now to FIGS. 2 and 3, a thimble 22 in accordance with an exemplary but non-limiting implementation of the invention is shown to include a substantially cylindrical wall 24 defining a center opening for supplying air to the interior of the liner or other component with a shield in the form of forward and rearward lips 26, 28 extending generally axially and perpendicularly to the cylindrical wall about upstream and downstream (relative to flow in the liner) edges of the cylindrical wall. In other words, the oppositely extending lips extend away from the cylindrical wall at two diametrically opposed locations, but without increasing the diameter of the cylindrical wall at two other diametrically opposed locations as best seen in FIG. 2. In a variation of the above, a full-circle rim or flange could be used in place of the discrete lips 26, 28. The hole 30, centered in the thimble, and defined by wall 24, is adapted to supply air to the liner in lieu of a hole 16 in which it is inserted.

Figure 4:
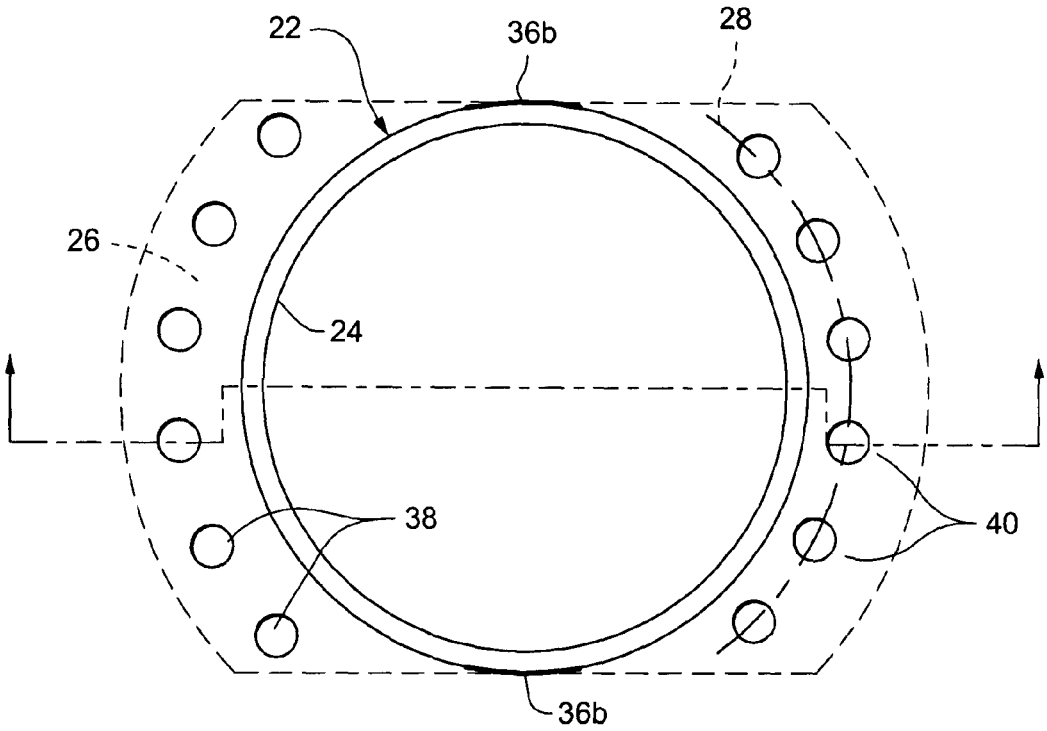
FIG. 4 is a partial top plan view of the insert of FIG. 2 located within an air mixing hole of a combustion liner.
Figure 5:
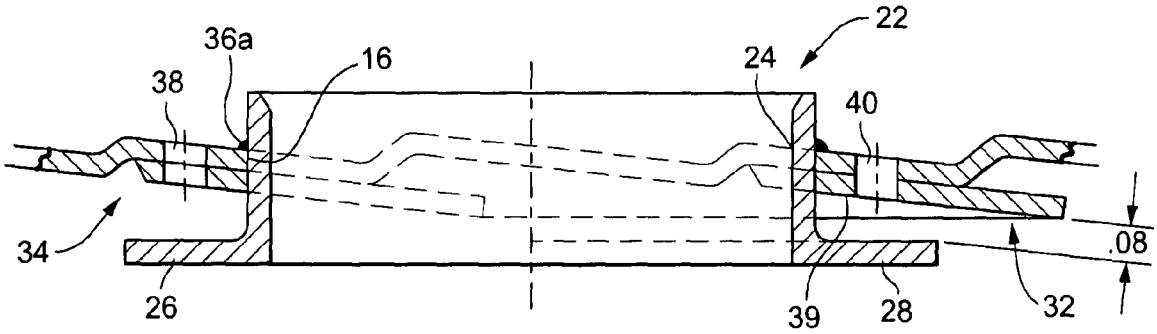
FIG. 5 is a section view taken along the line 5-5 of FIG. 4.

FIGS. 4 and 5 illustrate, by way of example only, axially segmented portions 32, 34 of a combustor liner with an air mixer or air dilution hole 16 formed therein. The thimble 22 is inserted into the hole 16 from within the combustor liner and oriented such that the lips 26, 28 face in opposed upstream and downstream directions. The thimble is secured within the air mixing hole by means of, for example, a fillet weld 36*a* extending about the hole 16 at the exterior interface with the thimble and 36*b* at two side locations on the interior surface. Two groups of smaller cooling holes 38, 40 are drilled in the combustor liner segments, in overlying relationship with the lips 26, 28, as best seen in FIGS. 4 and 5. The groups of cooling holes 38, 40 may be arranged along a concentric diametrical center line so as to be substantially centered along the curvature of the lips 26, 28, as defined by the thimble wall 24, but variations of this arrangement are contemplated. For example, the aft group of cooling holes may lie along a first radius, while the forward group of cooling holes may lie along a second radius larger than the first radius (see FIG. 4). In addition, the number of cooling holes above the upstream and downstream lips may vary. For example, there may be four, six, or eight holes on each lip, but it is also possible to have more holes on one lip than on the other. For example, the upstream or forward lip may have six equally-spaced holes and the downstream or aft lip may have seven equally spaced holes, or vice versa. In the non-limiting exemplary implementation, six cooling holes 38 and six cooling holes 40 are provided within the liner wall, overlying the respective lips 26, 28. It will be appreciated, however, that one or both of the holes 36 and/or 40 may be replaced by an accurate slot. The location of the thimbles themselves circumferentially about the liner or other component may also vary as needed.

The thimbles 22 are inserted into selected ones of the first row 18 air mixing holes 16. In this first exemplary, non-limiting embodiment, thimbles 22 are inserted into holes marked A and B in FIG. 1, at 90° and 150° circumferential locations, respectively, as shown in FIG. 1. The hole locations designated to receive the thimbles may vary as necessary. Initially, the holes are enlarged from a normal diameter of, for example, substantially 1.15 inches to a larger diameter hole of, for example, substantially 1.28 inches, and thimbles 22 are arranged within the enlarged liner holes so as to provide a radial gap of, for example, about 0.08 inch between the trailing edge of the downstream thimble lip and the interior liner surface 39, best seen in FIG. 5.

Figure 6:
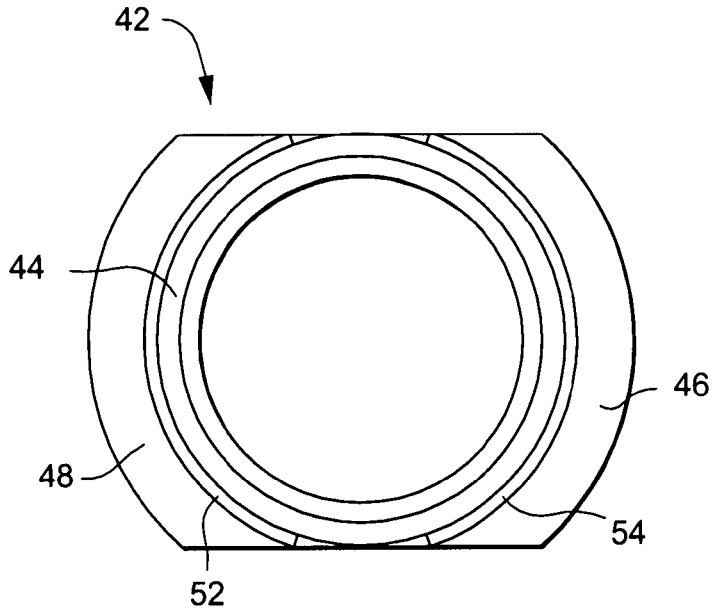
FIG. 6 is a plan view of a thimble insert in accordance with another non-limiting embodiment.
Figure 7:
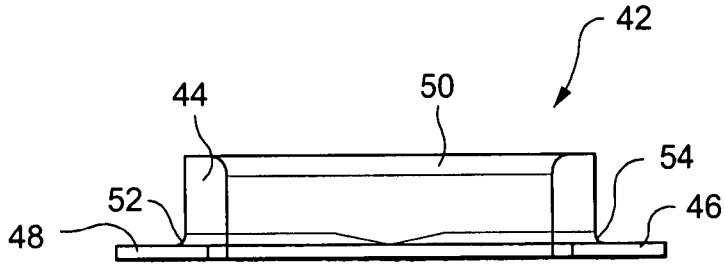
FIG. 7 is a front elevation of the thimble shown in FIG. 6.
Figure 8:
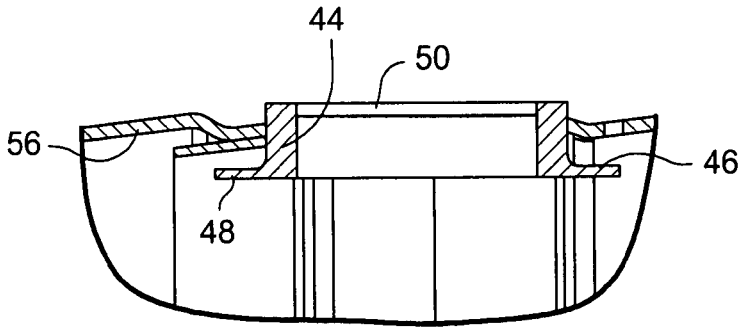
FIG. 8 is a partial cross-section of the thimble shown in FIGS. 6 and 7 inserted into a liner hole.

Turning now to FIGS. 6-8, a second non-limiting exemplary embodiment of a thimble 42 is illustrated. Thimble 42 is formed with a substantially cylindrical wall 44, with diametrically opposed forward and rearward lips 46, 48 extending axially and perpendicularly to the cylindrical wall 44, about upstream and downstream edges of the wall. In this embodiment, the dilution or mixing air entry end 50 of the hole defined by wall 44 is radiused (0.070±0.010 in., for example) to provide a smooth flow of air into the thimble. In addition, fillets 52, 54 extend about the wall 44 where the wall is joined to the lips 46, 48. The fillets may have a radius of 0.040±0.010 in., for example. These fillets also smooth the flow of cooling air onto and along the lips 46, 48. Note also that in this example, the cylindrical wall 44 has a thickness of 0.310 in., thus reducing the diameter of the liner hole from 1.46 in. to 1.15 in., but it will be understood that the change in liner hole diameter will be determined by the tuning requirements.

The liner (or other component) and the thimble are also preferentially provided with a thermal barrier coating (TBC) to preserve and protect the components from corrosion and/or erosion.

With the disclosed design, it was expected that any downstream heating of the liner wall at the downstream edges of the air dilution or air mixing holes 16 would be remedied by refilming of the flow downstream of the hole by the lip, based on experience with the prior art design exemplified in the '821 patent. In other words, the downstream lip adds a flow of cooling air along the liner wall surface (39 in FIGS. 5 and 56 in FIG. 8) just downstream of the mixing hole, it being understood that the normal flow of cooling air has been disrupted by the radial flow of air through the mixing hole. With regard to the upstream edge of the air mixing hole, however, it was not immediately apparent that providing a similar lip or surface extending in the opposite direction would be effective since the film flow would be in a direction of bulk flow, i.e., against the direction of the flow of hot combustion gases within the combustion chamber. It has been determined, however, that the cooling air through the cooling holes 38, impinging on the lip 26, is in fact, sufficient to cool the liner wall temperature upstream of the mixing hole.

It will be appreciated that the exact location, size, shape and spacing of the thimbles may vary within the scope of this invention, and that the method of attachment of the thimbles to the liner may also vary.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine hot gas path component comprising a substantially cylindrical body having at least one circumferential row of air mixing holes adapted to supply air in a radial direction into said substantially cylindrical body of the hot gas path component, a plurality of said air mixing holes each having a thimble fixed therein and extending radially into said substantially cylindrical body of the hot gas path component, said thimble having a substantially cylindrical body defining a center opening and a shield extending axially from an interior end of said thimble at diametrically opposed upstream and downstream locations, relative to a flow direction of hot gas through said substantially cylindrical body of the hot gas path component, within and substantially parallel to an inner surface of said substantially cylindrical body of the hot gas path component at both said upstream and downstream locations;

wherein said shield is spaced radially inward of said inner surface of said substantially cylindrical body of the hot gas path component; said shield not extending beyond said substantially cylindrical body of the thimble in two other diametrically opposed locations; and wherein said substantially cylindrical body of the hot gas path component is provided with plural cooling holes directly overlying said shield at said upstream and downstream locations.

2. The gas turbine hot gas path component of claim 1 wherein said substantially cylindrical body of said thimble is formed with a radiused inlet end.

3. The gas turbine hot gas path component of claim 1 wherein each of said air mixing holes having a thimble fixed therein is increased in diameter relative to air mixing holes not having a thimble fixed therein to enable reception of said thimble.

4. The gas turbine hot gas path component of claim 1 wherein said plural cooling holes comprises four or more cooling holes directly overlying said shield at said upstream and downstream locations.

5. The gas turbine hot gas path component of claim 1 wherein said at least one circumferential row of air mixing holes comprises plural rows including a first row and wherein one of said thimbles is located in each of said air mixing holes of said first row.

6. The gas turbine hot gas path component of claim 4 wherein said cooling holes overlying said shield at said upstream location lie along a first radius and said cooling holes overlying said shield at said downstream location lie along a second and different radius, as measured from said center opening.

7. A gas turbine combustor liner having at least one circumferential row of air mixing holes adapted to supply air in a radial direction into a combustion chamber within said combustor liner, one or more of said air mixing holes having a thimble fixed therein, said thimble having a substantially cylindrical body having a radiused exterior inlet end and a pair of lips including an upstream lip and a downstream lip extending from diametrically opposed locations on an interior end of said thimble in upstream and downstream directions within said combustor liner, relative to hot gas flow through said combustion chamber, said upstream lip and said downstream lip not extending beyond said substantially cylindrical body in two other diametrically opposed locations;

wherein said upstream lip and said downstream lip are radially inwardly spaced from an inner surface of said combustor liner; and wherein said combustor liner is provided with at least one opening overlying each of said upstream and downstream lips.

8. The gas turbine combustor liner of claim 7 wherein radiused fillets extend about junctures of said upstream and downstream lips and said cylindrical body.

9. The gas turbine combustor liner of claim 7 wherein said upstream and downstream lips are radially inwardly spaced from said inner surface of said combustor liner by about 0.08 in.

10. The gas turbine combustor liner of claim 7 wherein said at least one opening comprises plural cooling holes directly overlying each of said upstream and downstream lips.

11. The gas turbine combustor liner of claim 10 wherein said plural cooling holes overlying said upstream lip differ in number from said plural cooling holes overlying said downstream lip.

12. A method of cooling upstream and downstream edges of plural combustion air supply holes in a turbine combustor liner comprising:

a) enlarging a diameter of said plural combustion air supply holes;

b) inserting thimbles in said plural combustion air supply holes, each thimble having a substantially cylindrical body defining a center opening and a shield with first and second portions extending axially from an interior end of said thimble at diametrically opposed upstream and downstream locations within said combustor liner, relative to combustion gas flow through said turbine combustor liner, said first and second portion not extending beyond said substantially cylindrical body in two other diametrically opposed locations, said first and second portions spaced radially inwardly of an interior surface of said liner;

c) creating in said turbine combustor liner a plurality of cooling holes adjacent said combustion air supply holes, said cooling holes being located above said first and second portions of said shield; and d) introducing cooling air radially through said cooling holes to impingement cool said first and second portions of said shield.

13. The method of claim 12 wherein a different number of cooling holes overlie said first portion than said second portion.

14. The method of claim 13 wherein said cooling holes overlying said first portion lie along a first radius and said cooling holes overlying said second portion lie along a second and different radius, as measured from said center opening.

15. The method of claim 12 wherein said cylindrical body is formed with a radiused inlet end.

* * * * *